US009200224B2

(12) United States Patent
Kota et al.

(10) Patent No.: US 9,200,224 B2
(45) Date of Patent: Dec. 1, 2015

(54) SYSTEMS AND METHODS FOR COAL WATER SLURRY CONCENTRATION

(71) Applicant: General Electric Company, Schenectady, NY (US)

(72) Inventors: Siva Kumar Kota, Karnataka (IN); Annavarapu Vijay Bharat Sastri, Karnataka (IN); Vijayalakshmi Shah, Karnataka (IN)

(73) Assignee: General Electric Company, Schenectady, NY (US)

( * ) Notice: Subject to any disclaimer, the term of this patent is extended or adjusted under 35 U.S.C. 154(b) by 206 days.

(21) Appl. No.: 14/036,001

(22) Filed: Sep. 25, 2013

(65) Prior Publication Data

US 2015/0082690 A1 Mar. 26, 2015

(51) Int. Cl.
*C10L 5/00* (2006.01)
*C10L 1/32* (2006.01)

(52) U.S. Cl.
CPC ..... *C10L 1/326* (2013.01); *C10L 2290/06* (2013.01); *C10L 2290/08* (2013.01); *C10L 2290/10* (2013.01); *C10L 2290/141* (2013.01); *C10L 2290/24* (2013.01); *C10L 2290/28* (2013.01); *C10L 2290/52* (2013.01); *C10L 2290/545* (2013.01)

(58) Field of Classification Search
CPC ..... C10L 1/326; C10L 5/00
USPC ..... 44/280, 281, 282, 629, 639
See application file for complete search history.

(56) References Cited

U.S. PATENT DOCUMENTS

| | | | | |
|---|---|---|---|---|
| 4,490,213 | A * | 12/1984 | Anthony | 201/17 |
| 7,431,744 | B2 * | 10/2008 | Sugita et al. | 44/282 |
| 7,628,827 | B2 * | 12/2009 | Sugita et al. | 44/629 |
| 8,052,763 | B2 * | 11/2011 | Gallot | 23/295 R |
| 8,075,643 | B2 * | 12/2011 | Sugita et al. | 44/626 |
| 8,252,070 | B2 * | 8/2012 | Sugita et al. | 44/282 |
| 8,734,544 | B2 * | 5/2014 | Sugita et al. | 44/629 |
| 2012/0110908 | A1 | 5/2012 | Mazumdar et al. | |
| 2012/0241388 | A1 | 9/2012 | Shah | |
| 2013/0045143 | A1 | 2/2013 | Steele et al. | |
| 2014/0208637 | A1 * | 7/2014 | Bi et al. | 44/280 |

* cited by examiner

*Primary Examiner* — Ellen McAvoy
(74) *Attorney, Agent, or Firm* — Sutherland Asbill & Brennan LLP

(57) ABSTRACT

The present application provides a slurry concentration system for concentrating a flow of slurry. The slurry concentration system may include a boiler for producing a flow of steam, a first evaporator for concentrating the flow of slurry with the flow of steam and creating a first flow of water vapor, and a second evaporator positioned downstream of the first evaporator for further concentrating the flow of slurry with the first flow of water vapor and creating a second flow of water vapor.

20 Claims, 2 Drawing Sheets

SYSTEMS AND METHODS FOR COAL WATER SLURRY CONCENTRATION

TECHNICAL FIELD

The present application and resultant patent relate generally to the production of syngas and more particularly relate to systems and method for concentrating a coal water slurry with fewer moving parts, higher reliability, and lower operational costs as compared to known systems.

BACKGROUND OF THE INVENTION

Syngas may be produced using a gasification process in which a carbonaceous fuel source such as coal reacts with oxygen within a gasifier. The carbonaceous fuel source may include a coal slurry in which coal particles are dispersed within a liquid. The presence of the liquid within the slurry, however, may reduce the overall energy content of the syngas produced per unit weight of feed. The slurry therefore may be concentrated to remove a percentage of the liquid therein. Traditional equipment used to increase the slurry concentration includes device such as settlers, vacuum bed filters, agitators, pumps, thickeners, holding tanks, collection tanks, and the like with multiple rotating elements. The use of these parasitic devices may reduce plant availability and increase overall complexity.

There is thus a desire for improved systems and methods for concentrating coal water slurry before use. Preferably such systems and methods may provide such concentration with more reliability and less operating costs as compared to known devices with multiple rotating elements.

SUMMARY OF THE INVENTION

The present application and the resultant patent thus provide a slurry concentration system for concentrating a flow of slurry. The slurry concentration system may include a boiler for producing a flow of steam, a first evaporator for concentrating the flow of slurry with the flow of steam and creating a first flow of water vapor, and a second evaporator positioned downstream of the first evaporator for further concentrating the flow of slurry with the first flow of water vapor and creating a second flow of water vapor.

The present application and the resultant patent further provide a method of concentrating a coal water slurry. The method may include the steps of passing the coal water slurry through a first evaporator, vaporizing the coal water slurry with a flow of steam, creating a first flow of water vapor, passing the coal water slurry through a second evaporator, and further vaporizing the coal water slurry with the first flow of water vapor. This sequence may continue until the desired concentration of slurry is achieved.

The present application and the resultant patent further provide a slurry preparation system for creating a flow of slurry. The slurry preparation system may include a conditioning tank, a washing column, a first evaporator, a boiler for creating a flow of steam for the first evaporator, and a second evaporator positioned downstream of the first evaporator. A series of evaporators may be used.

These and other features and advantages of the present application and the resultant patent will become apparent to one of ordinary skill in the art upon review of the following detailed description when taken in conjunction with the several drawings and the appended claims.

DETAILED DESCRIPTION

Figure 1:
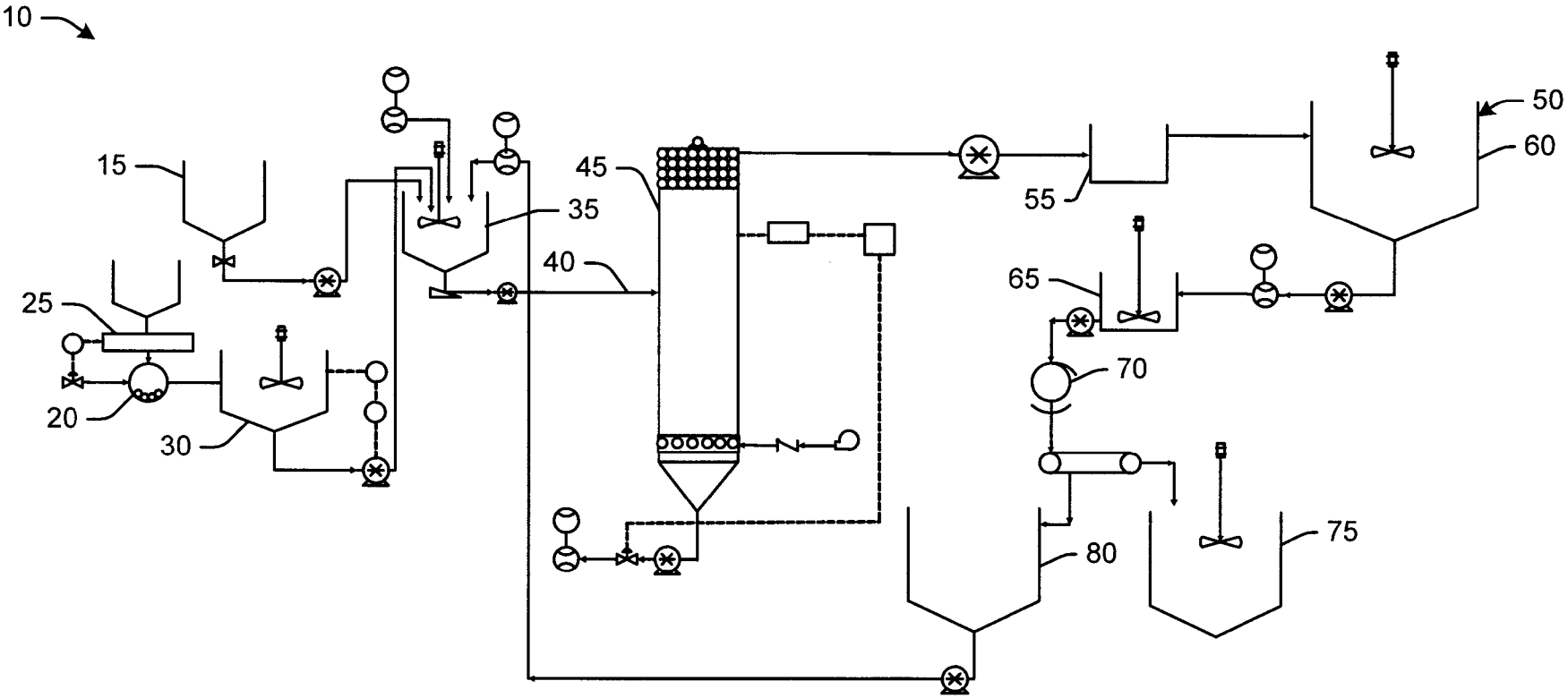
FIG. 1 is a schematic diagram of a known slurry preparation system with a slurry concentration system.

Referring now to the drawings, in which like numerals refer to like elements throughout the several views, FIG. 1 shows a known slurry preparation system 10. The slurry preparation system 10 may include a coal hopper 15 with an amount of coal therein. The coal may be fed to a mill 20 via a weigh feeder 25 or other type of flow control device. The coal may be pulverized within the mill 20. The pulverized coal may be sent to a mill discharge tank 30 and then pumped to a conditioning tank 35. The pulverized coal may be mixed with water and different types of additives to form a slurry 40 therein. The slurry 40 then may be pumped to a washing column 45. The washing column 45 may be used to remove ash and other types of particulates from the slurry 40. The slurry preparation system 10 and the components herein are described for the purpose of example only.

The slurry preparation system 10 also may include a slurry concentration system 50. The slurry concentration system 50 may include a collection tank 55 for settling the slurry 40 therein downstream of the washing column 45 or elsewhere. The slurry 40 may be sent to a thickener 60. The slurry 40 may thickened therein by high speed agitation, the use of additives, and the like. The slurry 40 may be forwarded to a holding tank 65. The holding tank 65 also may have a further agitator therein. The slurry 40 may be further concentrated via a high vacuum filter 70 and similar types of devices. The slurry 40 then may be transported to a slurry tank 75. The slurry tank 75 also may have a further agitator therein. At this point, the slurry 40 may be suitable for use in the gasifier or elsewhere. The water removed from the slurry may be recycled back to the conditioning tank 35 via a filtrate tank 80 or sent elsewhere.

As described above, the slurry concentration system 50 described herein is for the purpose of example only. The size, shape, and configuration of the components herein may vary. Many other types of slurry concentration systems and methods may be known. Note, however, the multiple types of agitators generally used therein to remove water from the slurry so as to increase the overall concentration of the slurry. The agitators and the other system components generally may be considered a parasitic draw on the overall power plant.

Figure 2:
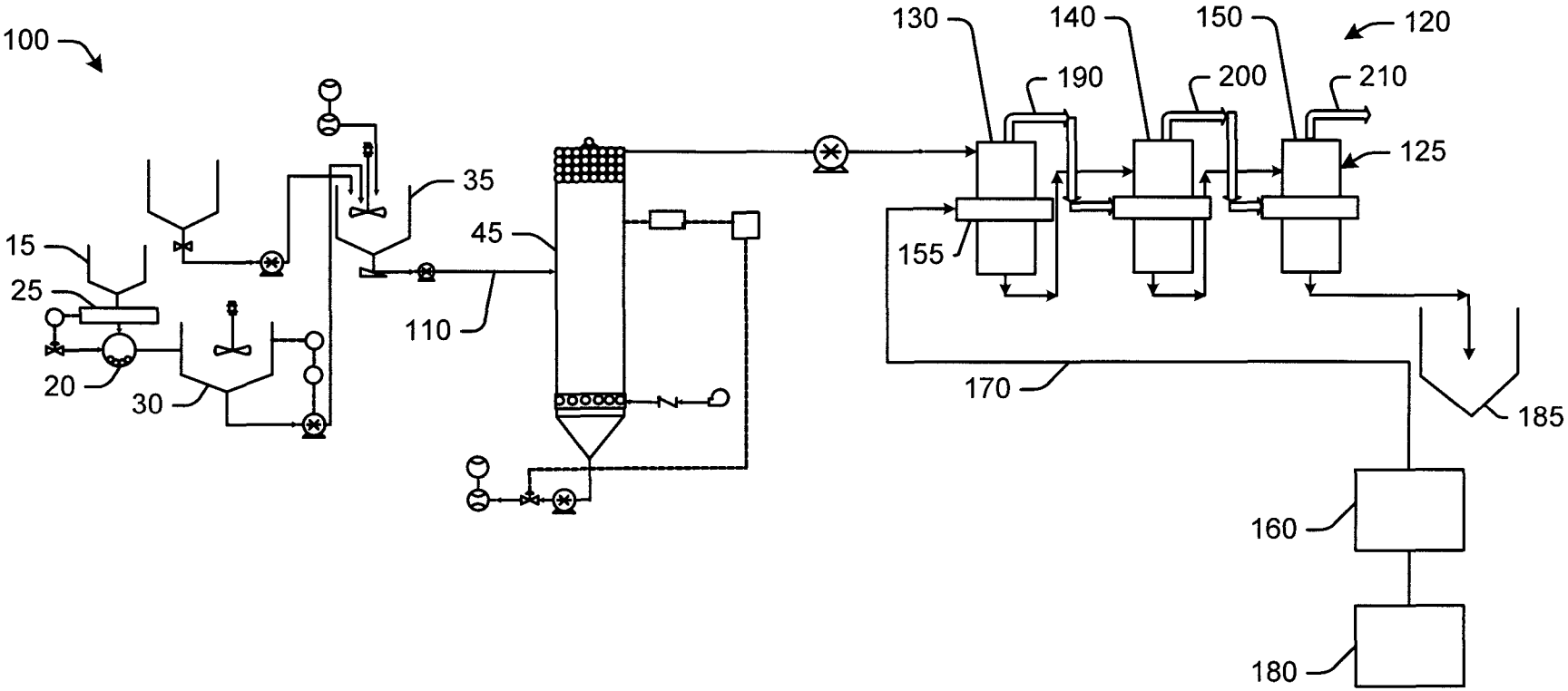
FIG. 2 is a schematic diagram of a slurry preparation system with a slurry concentration system as may be described herein.

FIG. 2 shows a slurry preparation system 100 as may be described herein. Similar to the system described above, the slurry preparation system 100 may include the coal hopper 15, the mill 20, the weight feeder 25, the mill discharge tank 30, the conditioning tank 35, and the washing column 45 to produce a flow of a slurry 110 from the coal and the like. These components may have any size, shape, or configuration. Other and different components also may be used herein to create the flow of slurry 110 such that the manner of creating the flow 110 may vary and is not considered to be limiting herein.

The slurry preparation system 100 includes a slurry concentration system 120. The slurry concentration system 120 may include a number of evaporators 125. The evaporators 125 may have any size, shape, configuration, or capacity. In this example, a first evaporator 130, a second evaporator 140, and a third evaporator 150 are shown although any number of the evaporators 125 may be used. Each evaporator 125 may include a stream chest 155 and the like for heat exchange with and vaporizing the flow of slurry 110. The steam chest 155 of the first evaporator 130 may be fed from a boiler 160 and the like. The boiler 160 may produce a flow of steam 170. The boiler 160 may be of conventional design. The boiler 160 may be fed from a liquid/gaseous fuel, low grade coal, or other type of waste heat source 180 and the like. For example, high ash coal from the washing column 45 or elsewhere may be used. Other types of heat sources and steam sources may be used herein. A slurry tank 185 may be positioned downstream of the evaporators 125. Other components and other configurations may be used herein.

In use, the slurry 110 may be fed into the first evaporator 130 with the flow of steam 170 from the boiler 160 for the initial case/start up. The heat from the steam 170 begins to vaporize the water within the slurry 110 to form a first flow of water vapor 190 and to increase the concentration of the slurry 110. The slurry 110 then may be pumped to the second evaporator 140. The first flow of water vapor 190 may be used as a heat source in the second evaporator 140. The first flow of water vapor 190 continues to vaporize the water remaining in the slurry 110 so as to increase the concentration of the slurry 110 and to create a second flow of water vapor 200. The slurry 110 then may be pumped to the third evaporator 150. The second flow of water vapor 200 continues to vaporize the water in the slurry 110 so as to increase further the concentration of the slurry 110 and to create a third flow of water vapor 210. This process may continue until the desired amount of water is vaporized so as to achieve a desired slurry concentration. The total number of evaporators may depend on the required concentration and/or flow rate. The remaining flow of vapor may be sent to a condenser and the like. Moreover, the remaining flow may be compressed and returned to the first evaporator 130 and the like. Other components and other configurations also may be used herein.

The slurry preparation system 100 thus may increase the concentration of the coal water slurry 110 by about ten percent (10%) to about sixty percent (60%) or more through the use of the slurry concentration system 120. The slurry concentration system 120 uses the multiple effect of the evaporators 130, 140, 150 in series to achieve the desired concentration. The slurry concentration system 120 thus provides effective concentration of the slurry 110 while reducing the number of moving parts required for concentration within a smaller footprint as compared to known systems. Moreover, the slurry concentration system 120 effectively utilizing power plant waste heat such that overall costs may be reduced with an increase in plant availability.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A slurry concentration system for concentrating a flow of slurry, comprising:

a boiler for producing a flow of steam;

a first evaporator for concentrating the flow of slurry with the flow of steam and creating a first flow of water vapor; and a second evaporator positioned downstream of the first evaporator for further concentrating the flow of slurry with the first flow of water vapor and creating a second flow of water vapor.

2. The slurry concentration system of claim 1, further comprising a third evaporator downstream of the second evaporator.

3. The slurry concentration system of claim 2, wherein the third evaporator further concentrates the flow slurry with the second flow of water vapor and creates a third flow of water vapor.

4. The slurry concentration system of claim 1, further comprising a waste heat source to power the boiler.

5. The slurry concentration system of claim 4, wherein the waste heat source comprises a liquid/gaseous fuel or a low grade coal.

6. The slurry concentration system of claim 1, wherein the first evaporator comprises a steam chest in communication with the boiler.

7. The slurry concentration system of claim 6, wherein the second evaporator comprises a steam chest in communication with the first flow of water vapor.

8. The slurry concentration system of claim 1, further comprising a slurry tank positioned downstream of the second evaporator.

9. The slurry concentration system of claim 1, wherein the slurry comprises a coal water slurry.

10. The slurry concentration system of claim 1, wherein the concentration of the slurry increases four or more times.

11. A method of concentrating a coal water slurry, comprising:

passing the coal water slurry through a first evaporator;

vaporizing the coal water slurry with a flow of steam;

creating a first flow of water vapor;

passing the coal water slurry through a second evaporator; and further vaporizing the coal water slurry with the first flow of water vapor.

12. The method of claim 11, further comprising the step of creating a second flow of water vapor.

13. The method of claim 12, further comprising the step of passing the coal water slurry though a third evaporator.

14. The method of claim 13, further comprising the step of vaporizing the coal water slurry with the second flow of water vapor.

15. The method of claim 14, further comprising the step of creating a third flow of water vapor.

16. A slurry preparation system for creating a flow of slurry, comprising:

a conditioning tank;

a washing column;

a first evaporator;

a boiler for creating a flow of steam for the first evaporator; and a second evaporator positioned downstream of the first evaporator.

17. The slurry preparation system of claim 16, further comprising a third evaporator downstream of the second evaporator.

18. The slurry preparation system of claim 16, further comprising a waste heat source to power the boiler.

19. The slurry preparation system of claim 18, wherein the waste heat source comprises a liquid/gaseous fuel or a low grade coal.

20. The slurry preparation system of claim 16, wherein the first evaporator comprises a steam chest in communication with the boiler.

* * * * *